US008466618B2

(12) United States Patent
Kando

(10) Patent No.: US 8,466,618 B2
(45) Date of Patent: Jun. 18, 2013

(54) DISCHARGE LAMP AND DISCHARGE LAMP DEVICE

(75) Inventor: Masashi Kando, Hamamatsu (JP)

(73) Assignee: National University Corporation Shizouka University, Shizouka-shi (JP)

( * ) Notice: Subject to any disclaimer, the term of this patent is extended or adjusted under 35 U.S.C. 154(b) by 68 days.

(21) Appl. No.: 13/375,370

(22) PCT Filed: Jun. 4, 2010

(86) PCT No.: PCT/JP2010/059563
§ 371 (c)(1),
(2), (4) Date: Nov. 30, 2011

(87) PCT Pub. No.: WO2010/140691
PCT Pub. Date: Dec. 9, 2010

(65) Prior Publication Data

US 2012/0074839 A1 Mar. 29, 2012

(30) Foreign Application Priority Data

Jun. 4, 2009 (JP) ..... 2009-135569

(51) Int. Cl.
*H05B 41/24* (2006.01)
*H01Q 1/26* (2006.01)

(52) U.S. Cl.
USPC ..... 313/594; 313/234; 313/607; 315/34

(58) Field of Classification Search
USPC ..... 313/594, 234, 607, 110; 315/34
See application file for complete search history.

(56) References Cited

U.S. PATENT DOCUMENTS

2007/0194683 A1 8/2007 Serita et al.

FOREIGN PATENT DOCUMENTS

| | | | |
|---|---|---|---|
| JP | 2007-115534 | A | 5/2007 |
| JP | 2007-227170 | A | 9/2007 |
| JP | 2007-317398 | A | 12/2007 |
| JP | 2008-140575 | A | 6/2008 |
| JP | 2008-140576 | A | 6/2008 |

OTHER PUBLICATIONS

English-language translation of International Preliminary Report on Patentability for Application No. PCT/JP2010/059563, dated Dec. 6, 2011.
International Search Report for PCT/JP2010/059563 dated Jun. 29, 2010.
English translation of the written opinion for PCT/JP2010/059563.

*Primary Examiner* — Anh Mai
*Assistant Examiner* — Elmito Breval
(74) *Attorney, Agent, or Firm* — Marshall, Gerstein & Borun LLP

(57) ABSTRACT

A discharge lamp including: a discharge vessel 10B configured by a light-transmissive non-electrically conducting member with a light-emitting substance sealed inside; one out of a pair of antenna members 10D with a portion at one end provided inside the discharge vessel 10B and a portion at the other end projecting outside the discharge vessel 10B and covered by a non-electrically conducting member; the other of the pair of antenna members 10D with a portion at one end provided inside the discharge vessel 10B and a portion at the other end projecting outside the discharge vessel 10B, covered by a non-electrically conducting member and capable of being connected to an electromagnetic waveguide path; and a loading coil 10E wound around the portion of the first antenna member 10D that is covered by the non-conducting member. A point light source can be achieved as well as performing power supply with good efficiency.

6 Claims, 4 Drawing Sheets

DISCHARGE LAMP AND DISCHARGE LAMP DEVICE

TECHNICAL FIELD

The present invention relates to a discharge lamp and a discharge lamp device.

BACKGROUND ART

Compact high-intensity discharge lamps (HID lamps) are widely used as light sources employed in vehicle headlights and projectors.

There are descriptions of microwave electrodeless lamps in Japanese Patent Application Laid-Open (JP-A) Nos. 2008-140575 and 2008-140576, configured with a transparent vessel including an inflation section with a sealed space in which a light-emissive substance is sealed and a pair of capillaries connected to face the inflation section; internal conductors sealed into each of the capillaries; and coils acting as external conductors wound at the outer periphery of the capillaries over substantially the length direction range of the internal conductors. Microwave electrodeless lamps configured in such a manner are illuminated by microwaves picked up by the coils, however they have low illumination intensity which is detrimental to practical implementation.

DISCLOSURE OF INVENTION

Technical Problem

Research is ongoing into making lamps into point light sources. However, when trying to achieve a point light source for a lamp the discharge length in the lamp becomes short, and the lamp (load) impedance becomes extremely small. Accordingly it becomes difficult to achieve a good match to an illumination circuit for illuminating the lamp, leading to the problem of the efficiency of power supply into the lamp falling.

In consideration of such circumstances the present invention is directed towards providing a high efficiency point light source type of discharge lamp in which it is possible to perform efficient power supply and a discharge lamp device of the same.

Solution to Problem

A discharge lamp of a first aspect of the present invention includes: a discharge vessel configured by a light-transmissive non-electrically conducting member having a light-emitting substance sealed inside; a first antenna member with a portion at one end provided inside the discharge vessel and a portion at the other end projecting outside the discharge vessel; a second antenna member with a portion at one end provided inside the discharge vessel and a portion at the other end projecting outside the discharge vessel and capable of being connected to electromagnetic waveguide means; and an external impedance section provided to the portion of the first antenna member that projects outside the discharge vessel.

A second aspect of the present invention is the discharge lamp of the first aspect wherein electrical discharge is generated at a gap between the one end portion of the first antenna member and the one end portion of the second antenna member by supplying electromagnetic waves from the electromagnetic waveguide means, and a resonance circuit for the electromagnetic waves is configured by the gap and the external impedance section.

A third aspect of the present invention is the discharge lamp of the first aspect or the second aspect wherein the external impedance section is configured by a loading coil wound around the portion of the first antenna member that projects outside the discharge vessel.

A fourth aspect of the present invention is the discharge lamp of the third aspect wherein a length of the coil is equivalent to one wavelength of the electromagnetic waves input to the second antenna member.

A fifth aspect of the present invention is the discharge lamp of the third aspect or the fourth aspect wherein: the portion of the first antenna member that projects outside the discharge vessel is covered by a non-electrically conducting member; and the coil is wound around the portion of the first antenna member that is covered by the non-electrically conducting member.

A sixth aspect of the present invention is a discharge lamp device including: an electromagnetic wave generation means for generating electromagnetic waves; an electromagnetic waveguide means for guiding the electromagnetic waves generated by the electromagnetic wave generation means and having an internal conducting body; and the discharge lamp of any one of the first aspect to the fifth aspect wherein the second antenna member of the discharge lamp has been connected to the electromagnetic waveguide means.

A seventh aspect of the present invention is the discharge lamp device of the sixth aspect wherein the electromagnetic waveguide means is a coaxial transmission path.

Advantageous Effects of Invention

According to the present invention a point light source can be achieved while maintaining power supply with good efficiency.

DESCRIPTION OF EMBODIMENTS

Detailed explanation follows regarding an exemplary embodiment of the present invention, with reference to the drawings. In the following an exemplary embodiment is explained of a discharge lamp device that employs a high voltage high-intensity discharge (HID) lamp as the discharge lamp.

Discharge Lamp Device Configuration

Figure 1:
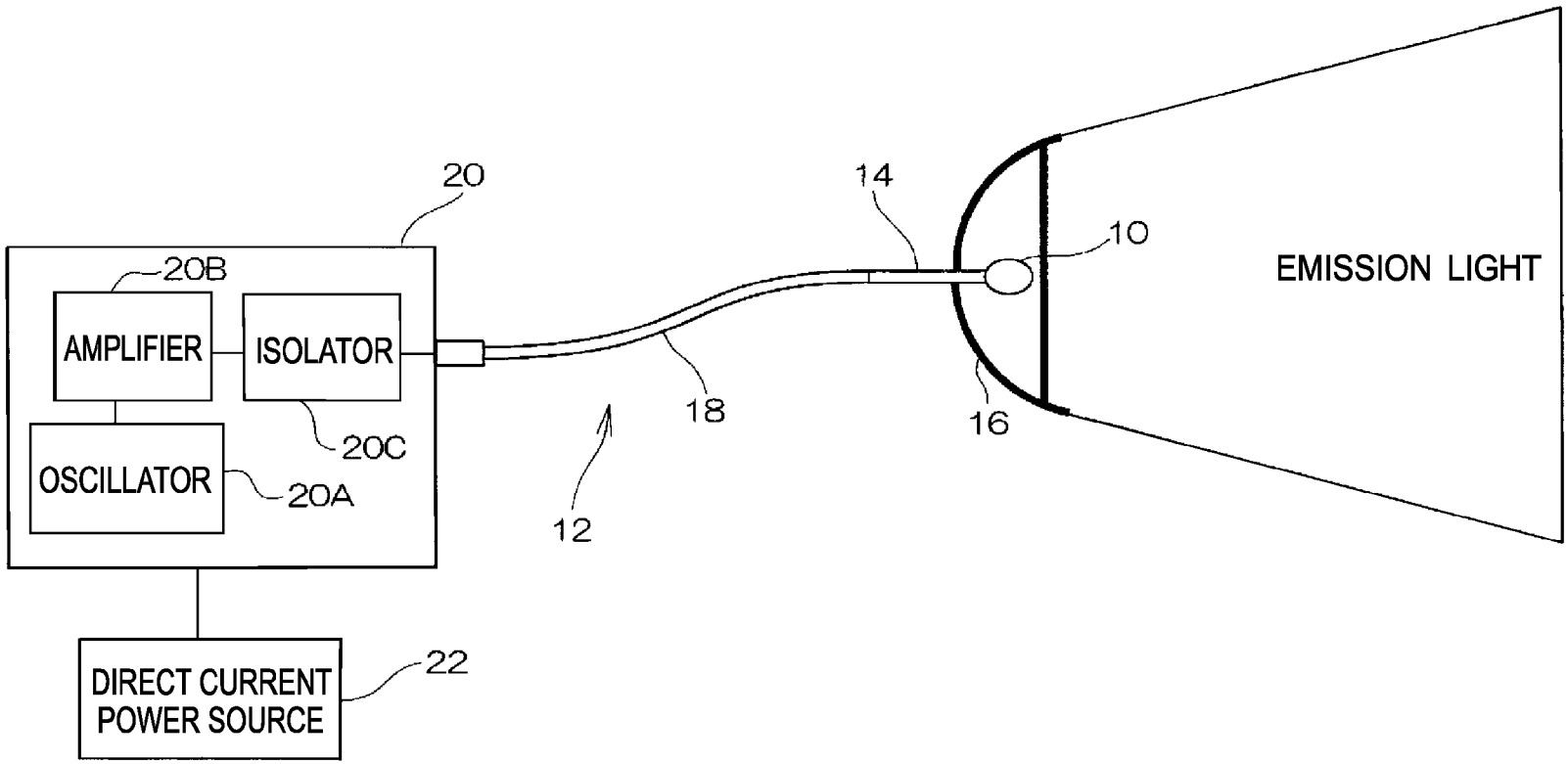
FIG. 1 is a schematic diagram illustrating an exemplary embodiment of a discharge lamp device of the present invention.

FIG. 1 is a diagram illustrating a configuration of a discharge lamp device according to an exemplary embodiment of the present invention. The discharge lamp device includes an HID lamp 10 that is a high-intensity discharge lamp, and a discharge lamp illumination device 12 for illuminating the HID lamp 10.

A launcher 14 is provided in the discharge lamp illumination device 12 to act as a wave guide for electromagnetic waves such as radiowaves (RF) or microwaves. A light collecting reflecting mirror 16 is fixed to one end of the launcher 14 such that the light emission section of the HID lamp 10 is positioned at the focal point of the light collecting reflecting mirror 16.

A compact solid state oscillator 20 is connected to the other end of the launcher 14 through a coaxial transmission line path 18 acting as a wave guide for electromagnetic waves. As the solid state oscillator 20, for example, a solid state oscillator may be employed provided with an oscillator 20A, an amplifier 20B and an isolator 20C. A direct current power source 22 is connected to the solid state oscillator 20 for outputting a voltage of, for example, 28V. The voltage of the direct current power source 22 is variable.

Figure 2:
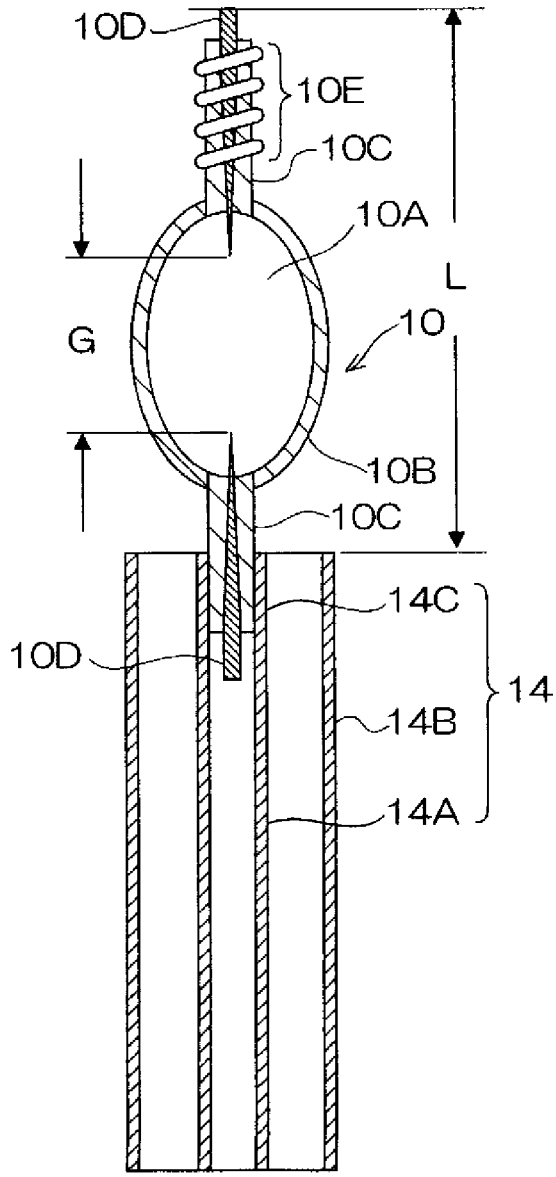
FIG. 2 is a schematic diagram illustrating a discharge lamp and launcher.

FIG. 2 is a diagram illustrating a configuration of the HID lamp 10. The HID lamp 10 includes an elliptical shaped discharge vessel 10B configuring an internal discharge space 10A and a pair of bar shaped members 10C. A light-emissive substance configured from, for example, xenon gas with trace additives is sealed inside the discharge vessel 10B. The pair of bar shaped members 10C are provided so as to extend out along the line of the long axis direction of the discharge vessel 10B with a specific separation between each other.

Each of the pair of bar shaped members 10C has one end inserted into the discharge space 10A, and the other end exposed outside the discharge vessel 10B. Metal bar shaped antenna members 10D formed with pointed leading ends are embedded at the central axis of the respective bar shaped members 10C. At the inside of the discharge vessel 10B each of the antenna members 10D is exposed and not embedded in the bar shaped members 10C. The antenna members 10D are configured from, for example, tungsten or molybdenum. In order to avoid damage caused by difference in thermal expansion coefficients between the metal material of the antenna members 10D and insulating bodies, configuration may be made such that tungsten bar shapes are each connected to respective two ends of molybdenum foil. In the present exemplary embodiment high frequency power is consumed with high efficiency in the discharge section for emitting light, and there is hardly any heat emitted at the junction sections between the discharge vessel 10B and the antenna members 10D. Accordingly a cost saving may be achieved by omitting such a structure.

The discharge vessel 10B and the pair of bar shaped members 10C are formed from a high permittivity insulating body such as quartz or alumina, these being non-electrically conducting materials with light transmissivity. The leading end portions of the pair of antenna members 10D are inserted into the discharge vessel 10B so as to be separated from each other with a separation gap G. Each other end of the antenna members 10D projects outside from the discharge vessel 10B in a state covered by the respective bar shaped member 10C. The pair of antenna members 10D are thus disposed with a separation of the gap G from each other.

The bar shaped portion 10C on the side that is not connected to the launcher 14 out of the pair of bar shaped portions 10C has a portion that is exposed to the outside of the discharge vessel 10B and has a helical coil (loading coil) 10E wound thereon. Due to the loading coil 10E being wound on the non-electrically conducting member bar shaped portion 10C there is no continuity to the antenna member 10D embedded at the central axis of the bar shaped portion 10C. The loading coil 10E prevents microwaves guided from the launcher 14 from leaking out from the bar shaped portion 10C. Further explanation is given later regarding the loading coil 10E.

The launcher 14 includes an internal circular cylindrical member 14A and an external circular cylindrical member 14B, provided coaxially to the internal circular cylindrical member 14A so as to surround the internal circular cylindrical member 14A with a specific separation distance to the outside face of the internal circular cylindrical member 14A. The internal circular cylindrical member 14A and the external circular cylindrical member 14B are configured from conductors such as metal. The leading end portion of the internal circular cylindrical member 14A is formed with an attachment portion 14C for insertion of the bar shaped portion 10C, into which the antenna member 10D of the HID lamp 10 has been embedded and to which the HID lamp 10 is attached. Electrically connecting the antenna member 10D to the internal circular cylindrical member 14A improves the microwave transmission efficiency, raising luminous efficacy. Configuration may be made in which a circular pillar shaped member provided with the attachment portion 14C projecting out from a leading end portion is employed in place of the internal circular cylindrical member 14A. A female N-type connector in which a solid state microwave oscillator is used as an output terminal may also be employed as the launcher 14.

A wave guide path is configured between the outside face of the internal circular cylindrical member 14A and the inside face of the external circular cylindrical member 14B, to guide electromagnetic waves that have been oscillated by the solid state oscillator 20 and wave-guided along the coaxial transmission path, such that the electromagnetic waves are supplied into the HID lamp 10 attached to the attachment portion 14C.

According to the present exemplary embodiment, the microwaves oscillated by the solid state oscillator 20 are guided through the coaxial transmission path to the end portion of the launcher 14, wave-guided in the coaxial transmission path of the launcher 14 and supplied to the HID lamp 10 attached to the attachment portion 14C. The antenna member 10D is exposed from the discharge vessel 10B, the antenna member 10D is inserted into the internal circular cylindrical member 14A and electrically connected to the coaxial transmission path of the launcher 14. Accordingly the supplied electromagnetic waves are directly guided into the discharge vessel 10B through the antenna member 10D, electromagnetic wave propagation at a high impedance portion of the antenna prior to lamp illumination is avoided, and electromagnetic waves are emitted from a high impedance localized location. Due to the presence of the emitted electromagnetic waves inside the discharge vessel 10B, the light-emitting substance in the vicinity of the emitting location is selectively excited, and the light-emitting substance, such as high pressure gas, inside the vessel achieves efficient discharge.

In the state in which the HID lamp 10 is attached to the launcher 14, electromagnetic waves are emitted into the surrounding space with good efficiency when the separation distance L between the end portion of the external circular cylindrical member 14B and the end portion of the antenna not inserted into the internal circular cylindrical member, namely the length of the portion of the antenna projecting out from the external circular cylindrical member, is ¼ the length of the wavelength $\lambda$ of the electromagnetic waves. In such cases a strong electromagnetic field is generated in the gap G provided partway along the separation distance L. The electromagnetic field is sufficiently strong, enabling discharge to be easily configured even at high pressure gas.

The present exemplary embodiment is configured such that by shortening the length of the gap G the length of the light emitting portion is shortened, so as to configure a point light source. However, by lengthening the gap G the discharge region is made wider, enabling illumination of an intermediate or large scale high pressure HID lamp 10.

There is no influence to the initiation or continuance of discharge even when, as in the present exemplary embodiment, the antenna member 10D is covered with a permissive body having low dielectric loss, high permittivity and heat resistance. Accordingly, a lamp provided with an antenna of the present exemplary embodiment can be treated as effectively being an electrodeless discharge lamp.

As explained above, good efficiency of discharge can be achieved in high pressure gas sealed in the discharge vessel 10B due to the discharge lamp device of the present exemplary embodiment directly supplying electromagnetic waves through the antenna and into the discharge vessel 10B, and due to the electromagnetic field being locally concentrated in the vicinity of the leading end portion of the antenna. A high temperature high density plasma is generated due to the sealed gas being at high pressure. The diffusion speed of the high temperature high density plasma is slow due to the high gas pressure in the lamp, localizing plasma with a discharge profile in the electromagnetic field distribution in the vicinity of the antenna and causing high intensity light emission.

A high pressure argon or xenon gas is sealed as the base gas, sealed with additives of NaI, ScI. Accordingly, due to easy electron separation and light emission occurring, light emission is achieved with good coloration properties and high luminous efficacy. All of the gases shown in Table 1, which may be employed in discharge lamps, metal halide lamps, and the HID lamp 10, may be employed as base gases and additives. Molecular gases such as $S_2$ that are recently employed may also be used.

TABLE 1

| | |
|---|---|
| High Pressure Sodium | Ar + Na, Xe + Na |
| High Pressure Mercury Lamps | Ar + Hg, Xe + Hg |
| High Pressure Xenon Lamps | Xe |
| Metal Halide Lamps | Ar or Xe + inclusions of: SnI2, ScI3, InI, TlI, NaI, DyI3, Hg |
| Molecular Emission Lamps | Ar or Xe + inclusions of: S2, Se2, Te2, GeS, GeSe, GeTe, OH |
| Cluster Lamps | Inclusions of: Re2O7/Xe, WO2Br2/CsBr/Ar |

[Issues Related to Luminous Efficacy when Narrowing Gap G to Achieve a Point Light Source.]

It becomes difficult to illuminate with high luminous efficacy when the gap G between electrodes or antenna is narrowed in the space maintaining the plasma in order to achieve a point light source. A more detailed explanation regarding this point follows.

Incident power T to the lamp is composed of power A consumed to generate and maintain electrical discharge, and also power B emitted into the space and power C that is reflected by the lamp and returns to the power source side. A lamp employing an illumination method capable of achieving a large A/T has high luminous efficacy. It is therefore necessary to have a discharge method capable of making B and C as small as possible.

In order to make C small it is necessary to satisfy two conditions (a resonance condition and a matching condition).

Resonance condition: if the lamp is treated as having a load impedance $Z_L$ configured by the (1) discharge section and the (2) antenna (electrode), then the resonance condition is satisfied and ineffective power can be eliminated when the reactance X of the $Z_L$ is zero.

Matching condition: Power supplied from a power source to a load is maximized when the resistance R of the $Z_L$ is equivalent to the characteristic impedance $Z_0$ of the transmission line path connecting the power source to the load.

The above resonance condition and matching condition are met when Equation (1) and Equation (2) below are satisfied.

$$\nu_e = \frac{1}{C_P Z_0} \quad \text{Equation (1)}$$

$$\omega_P^2 = \omega^2 + \nu_e^2 \quad \text{Equation (2)}$$

wherein $\nu_e$ is the impact frequency between electrons and other particles, and $C_p$ is capacitance, as explained later. ω is the microwave angular frequency and $\omega_p$ is the electron plasma angular frequency.

R exhibits the relationship $R \propto PG/N$ with respect to G, the sealed gas pressure P and the plasma density N. The matching condition is no longer matched when G<2 mm and $R<Z_0$, lowering the discharge efficiency.

The light emission amount F is proportional to the surface area S of the discharge length and to N, and S is proportional to G. When G is shortened to 1/N then the plasma density N needs to be raised by a multiple of n in order to maintain an equivalent F for the same incident power T.

It can be seen from the above that P is proportional to $1/G^2$ while R remains constant. Namely, if G is made 1/n then P needs to be increased $n^2$ times.

Consequently, when G is made smaller to achieve a point light source, it is not possible to satisfy the matching condition and resonance condition and achieve high efficiency illumination unless P can is raised. Lamp sealed gas pressure with existing technology is between about 50 atmospheres and 200 atmospheres during illumination. There is a high likelihood of blackening due to increasing pressure occurring, leading to loss of transparency of the lamp walls.

[Compensating for the Capacitance of Gap G]

In the HID lamp of the present exemplary embodiment the electrode can be treated as a monopole antenna, and microwave power is supplied to the antenna gap G at the lamp center portion. When discharge has illuminated stably and a high density plasma has been formed the gap is shorted by the plasma, and a monopole antenna is complete. However, when G is shortened, then effectively a large capacitance $C_p$ is introduced in series to the monopole antenna, collapsing the resonance condition of the monopole antenna, and causing a large increase in ineffective power.

This makes it necessary to mount the coil with an inductance $L_H$ at the leading end portion of the lamp in order to restore the resonance condition.

The loading coil 10E is a serial circuit with a capacitor $C_H$ configured between quartz acting as a dielectric body and the loading coil 10E and inductance $L_H$ of the loading coil 10E. The loading coil 10E exhibits the following effect during lamp illumination.

A high density plasma is first generated during lamp illumination, and the impedance $Z_p$ of the discharge portion=0, hence the microwaves from the monopole antenna are externally discharged. The loading coil 10E forms a resonance circuit with the inductance $L_H$ of the loading coil 10E itself and the capacitance $C_H$, supplementing for microwaves attempting to leak out.

Second, the supplemented microwaves assist plasma generation during the interval for passing to and fro within the resonance circuit at the top portion antenna leading end portion.

Third, the luminous efficacy is improved as a result. Since $C_p$ becomes large in a point light source AEMD lamp with shortened antenna gap, the shorting state of the lamp becomes closer and the luminous efficacy falls, however the loading coil 10E exhibits an effect in such cases.

Explanation follows regarding the principle by which the luminous efficacy is improved by mounting a helical coil as the loading coil 10E.

In order to make a lamp into a point light source then first G needs to be made small. When the matching condition and the resonance condition are satisfied, then making G smaller corresponds to a drop in the plasma density, as can be seen from Equation (1) and Equation (2), and therefore light emission intensity falls. Hence in such cases, as described later, a helical coil mounted to the upper side the antenna member 10D exhibits an effect of increasing the emission intensity of the smaller G.

It can be seen that problems arise with an AEMD lamp both prior to illumination and during illumination. These problems can be solved by mounting the helical coil on the lamp upper portion. If the inductance of the helical coil is denoted by $L_H$, and the capacitance to the upper side antenna member 10D is denoted by $C_H$, then the reactance of the lamp impedance is as expressed by Equation (3) below.

$$X = \omega L + \omega L_H - \frac{1}{\omega C} - \frac{1}{\omega C_H} - \frac{\left(\omega C_P - \frac{1}{\omega L_P}\right) R_P^2}{1 + \left(\omega C_P - \frac{1}{\omega L_P}\right)^2 R_P^2} = X_H + \Psi \quad \text{Equation (3)}$$

The resonance condition of a monopole antenna $\omega L = 1/\omega C$ is applicable. $X_H$ and $\psi$ are as expressed in the following Equation (4) and Equation (5).

$$X_H = \omega L_H - \frac{1}{\omega C_H} \quad \text{Equation (4)}$$

$$\Psi = -\frac{\left(\omega C_P - \frac{1}{\omega L_P}\right) R_P^2}{1 + \left(\omega C_P - \frac{1}{\omega L_P}\right)^2 R_P^2} \quad \text{Equation (5)}$$

$\psi$ changes from minus→0→plus as $\omega_p^2$ increases with the microwave incident power. Consequently, if $X_H$ is preset<0, then $\omega_p^2$ when the resonance condition X=0 is satisfied is larger than when $X_H$=0, and so an increase in the amount of light can be achieved even in a point light source lamp with small G. This can be understood by considering when $\omega_p^2$ satisfies the conditions expressed by following Equation (6), and microwave power from the monopole antenna attempting to leak outside the lamp is accumulated in the resonance circuit of $L_H$ and $C_H$ formed by the helical coil, efficiently utilizing discharge illumination.

$$X = X_H + \psi = 0 \quad \text{Equation (6)}$$

However, if the antenna gap is decreased further in order to achieve a point light source, for example to 1 mm or less, then $1/\psi C_p$ becomes smaller than $R_p$ and $\psi L_p$, and microwaves cease to generate a plasma, bypass the Cp and leak out from the lamp. In such cases since the helical coil accumulates the power of microwaves attempting to leak out and suppresses leaking, the luminous efficacy of the lamp can be improved.

[Reducing Emission Resistance]

When a high density plasma is generated in the antenna gap and the gap is effectively shorted, the lamp has an equivalent value to a monopole antenna, and emission resistance increases. Namely, the electromagnetic waves (microwaves) incident to the lamp are discharged efficiently into the space causing loss. As an equivalent circuit this can be treated as an emission resistance, resulting in wastage. The loading coil functions as an accumulation element for the electromagnetic wave power of the electromagnetic wave (microwave) power, and a reduction in the emission resistance can be achieved.

The length L of the loading coil wire is optimally one wavelength of the electromagnetic waves (microwaves). In such cases a standing wave is excited in the loading coil. The two ends of the standing wave exhibit maxima (standing wave anti-nodes), and the central portion exhibits a minimum (standing wave node). Hence, when the leading end at one end of the loading coil is placed in the vicinity of the discharge section (10B), since the microwave field (standing wave anti-node) excited there contributes to generating and maintaining discharge, the emission resistance is lowered, and the luminous efficacy is greatly enhanced.

Figure 3:
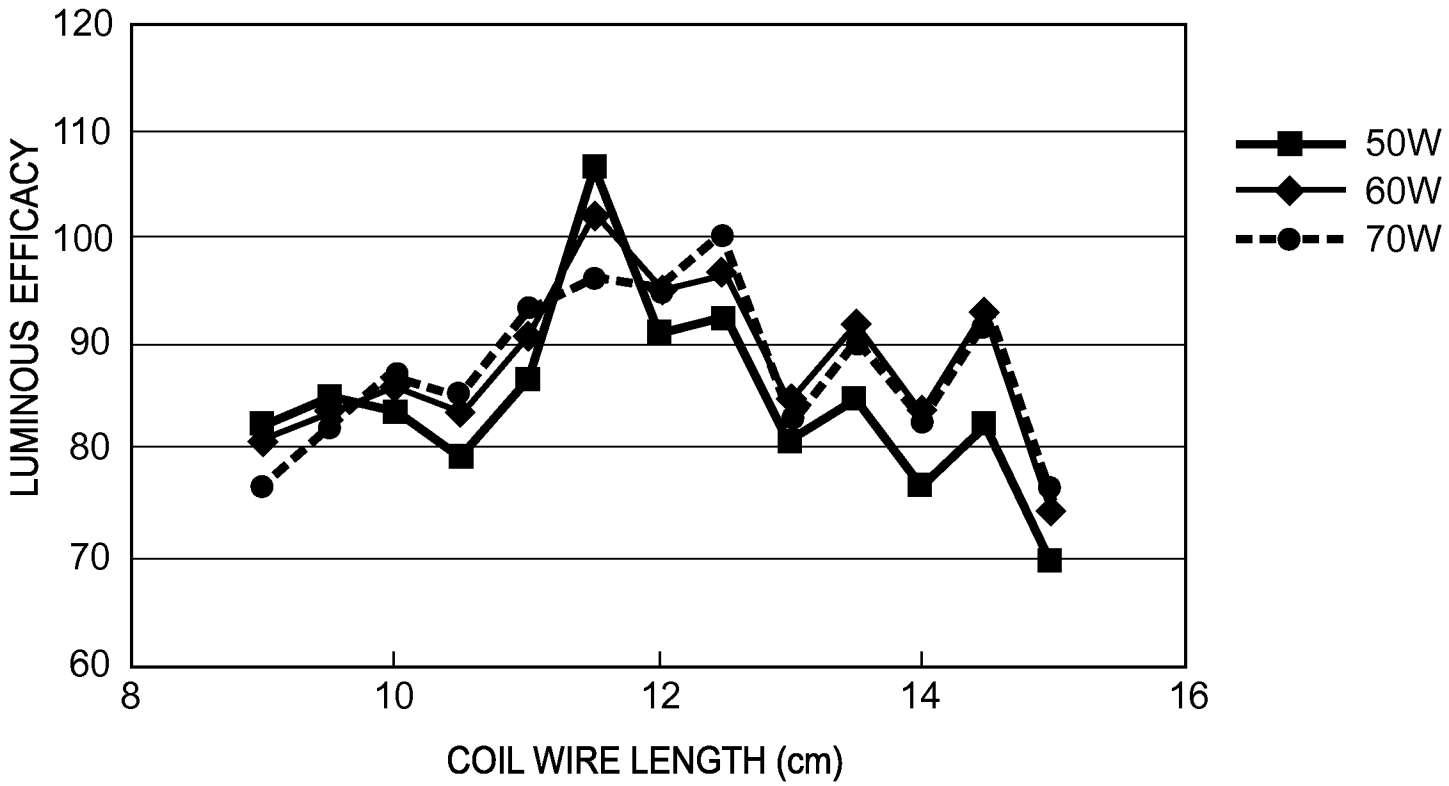
FIG. 3 is a graph illustrating measurement results of luminous efficacy against coil wire length.

FIG. 3 is a diagram illustrating measurement results of luminous efficacy against coil wire length. The number of windings is not optimized. It can be seen that when L is near to one wavelength of the microwaves then the luminous efficacy is at a maximum.

[Loading Coil Material]

Loading coils accumulating microwave power of several tens of W are possible, heating to high temperature. The material of a loading coil hence needs to be a material capable of withstanding high temperature, and also a material with plasticity in order to readily form into a helical coil. Appropriate materials for the loading coil from the perspectives of temperature resistance and plasticity include molybdenum, tantalum, and rhenium. Tungsten may also be employed as the material for the loading coil.

[Loading Coil Shape and Attachment Position]

The luminous efficacy is improved by using the strong microwave field occurring at the leading end portion of the loading coil to maintain discharge. The luminous efficacy can be raised by optimizing the shape and attachment position of the coil. The loading coil may also be molded into glass.

Explanation follows regarding test results when a loading coil is mounted. A D2-type metal halide lamp is employed with an antenna wire diameter of 0.35 mm, antenna gap of 1.5 mm, xenon gas sealed at 10 atmospheres, 0.5 mg of $NaI+ScI_3$ added and 0.5 mg of Hg added. The luminous efficacy is measured when the helical coil is mounted and when not mounted.

Figure 4:
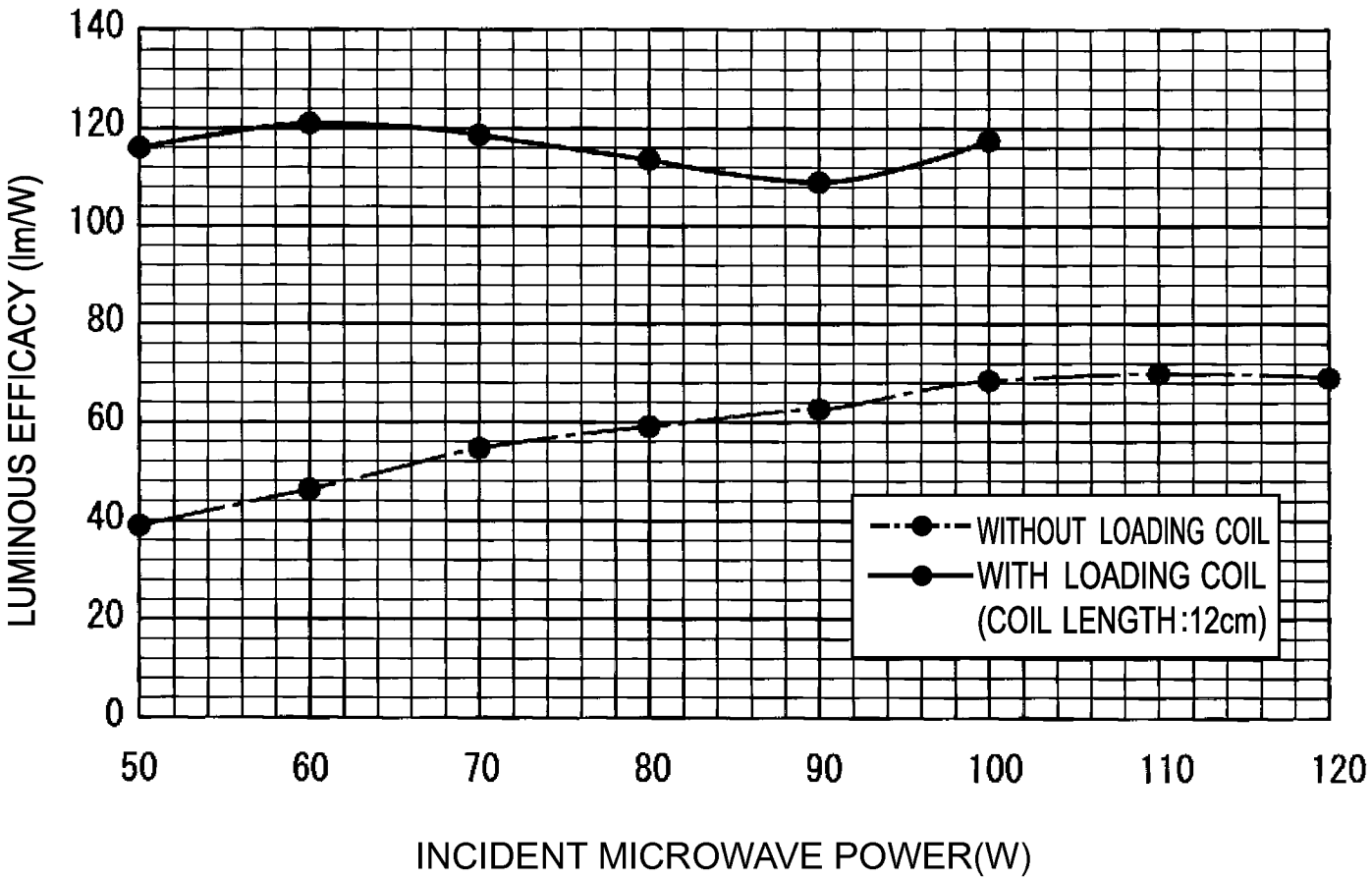
FIG. 4 is a graph illustrating measurement results of luminous efficacy against incident microwave power.

It can be seen, as shown in FIG. 4, that the luminous efficacy can be improved by mounting the helical coil.

Explanation follows regarding comparative results between the properties of an AEMD lamp and an AC/DC discharge lamp.

Properties when applying an AEMD lamp and an AC/DC discharge lamp in a visible light source metal halide lamp are shown in the following Table 2.

TABLE 2

| | AEMD Metal Halide Lamp | AC/DC Metal Halide Lamp |
|---|---|---|
| Luminous Efficacy | 120 to 140 lm/W | 90 to 100 lm/W |
| Total Light Bundle | 4,800 to 14,000 lm | 4,000 lm |

TABLE 2-continued

| | AEMD Metal Halide Lamp | AC/DC Metal Halide Lamp |
|---|---|---|
| Lamp Life | 40,000 hours or more | up to 4,000 hours |
| Coloration Evaluation Number (Ra) | up to 85 | up to 85 |
| Input | 40 to 120 W | 40 W |
| Shape of Light Emitting Section | L1.5 to 3.5 mm × ϕ1 mm | L3.5 mm × ϕ1 mm |
| Main Applications | Vehicle Headlights, Street Lights, Plant Factories | Vehicle Headlights |

It can be seen from Table 2 that an AEMD lamp has good luminous efficacy, long lamp life, and enables a better point light source to be achieved.

Properties when applying an AEMD lamp and an AC/DC discharge lamp in an UV mercury lamp are shown in the following Table 3.

TABLE 3

| | AEMD Mercury Lamp | AC/DC Discharge Mercury Lamp |
|---|---|---|
| Wavelength of Emission Light | 245 nm, 365 nm | |
| Emission Light Power Density | 5 to 10 (W/cm$^2$) | |
| Lamp Life | 40,000 hours or more | up to 2,000 hours |
| Shape of Light Emitting Section | L1.5 × ϕ1 mm | L3 mm × ϕ1 mm |
| Input | up to 50 W | 200 W |
| Main Applications | UV sources for spot light devices, precision welding of electrical components and optical components, DVD bonding | |

It can be seen from Table 3 that an AEMD lamp has good long lamp life, enables a better point light source to be achieved, and enables a reduction in power consumption to be achieved.

Properties when applying an AEMD lamp and an AC/DC discharge lamp in a VUV eximer lamp are shown in the following Table 4.

TABLE 4

| | AEMD Xenon Lamp | AC/DC Discharge Heavy Hydrogen Lamp |
|---|---|---|
| Wavelength of Emission Light | 172 nm | 185 nm |
| Emission Light Power Density | 35 mW/cm$^2$ | several tens of nW/cm$^2$ |
| Lamp Life | 40,000 hours or more | up to 2,000 hours |
| Shape of Light Emitting Section | L1.5 × ϕ1 mm | L3.5 mm × ϕ1 mm |
| Input | up to 5 W | 20 to 200 W |
| Main Applications | Ultraviolet Spectrophotometry, Atomic Absorption Spectrophotometry, Medical Diagnostic Devices, Concentration Measurement, Liquid Chromatography, Capillary Electrophoresis | |

It can be seen from Table 4 that an AEMD lamp has high light emission intensity, long lamp life, enables a better point light source to be achieved, and enables a reduction in power consumption to be achieved.

Utilizing the function of a loading coil such as described above enables a lamp with high efficiency illumination to be achieved even when G<2 mm and even with a sealed gas pressure P that is a level of P achievable in lamp manufacture. Furthermore, a high efficiency illumination is achievable even when G<1. Namely, a high efficiency point light source lamp can be realized by utilizing the loading coil.

EXPLANATION OF THE REFERENCE NUMERALS

10 HID LAMP
10A DISCHARGE SPACE
10B DISCHARGE VESSEL
10C BAR SHAPED MEMBER
10D ANTENNA MEMBER
10E LOADING COIL
12 DISCHARGE LAMP ILLUMINATION DEVICE
14 LAUNCHER
14A INTERNAL CIRCULAR CYLINDRICAL MEMBER
14B EXTERNAL CIRCULAR CYLINDRICAL MEMBER
20 SOLID STATE MICROWAVE OSCILLATOR
22 DIRECT CURRENT POWER SOURCE

The invention claimed is:

1. A discharge lamp comprising:

a discharge vessel configured by a light-transmissive non-electrically conducting member having a light-emitting substance sealed inside;

a first antenna member with a portion at one end provided inside the discharge vessel and a portion at the other end projecting outside the discharge vessel;

a second antenna member with a portion at one end provided inside the discharge vessel and a portion at the other end projecting outside the discharge vessel and capable of being connected to electromagnetic waveguide means; and an external impedance section provided to the portion of the first antenna member that projects outside the discharge vessel, wherein the external impedance section is configured by a loading coil wound around the portion of the first antenna member that projects outside the discharge vessel for preventing leakage of microwaves from the first antenna member.

2. The discharge lamp of claim 1, wherein electrical discharge is generated at a gap between the one end portion of the first antenna member and the one end portion of the second antenna member by supplying electromagnetic waves from the electromagnetic waveguide means, and a resonance circuit for the electromagnetic waves is configured by the gap and the external impedance section.

3. The discharge lamp of claim 1, wherein a length of the loading coil wire is equivalent to one wavelength of the electromagnetic waves input to the second antenna member.

4. The discharge lamp of claim 1, wherein:

the portion of the first antenna member that projects outside the discharge vessel is covered by a non-electrically conducting member; and the loading coil is wound around the portion of the first antenna member that is covered by the non-electrically conducting member.

5. A discharge lamp device comprising:

an electromagnetic wave generation means for generating electromagnetic waves;

an electromagnetic waveguide for means guiding the electromagnetic waves generated by the electromagnetic wave generation means and having an internal conducting body; and the discharge lamp of claim 1 wherein the second antenna member of the discharge lamp has been connected to the electromagnetic waveguide means.

6. The discharge lamp device of claim 5 wherein the electromagnetic waveguide means is a coaxial transmission path.

* * * * *

UNITED STATES PATENT AND TRADEMARK OFFICE

CERTIFICATE OF CORRECTION

PATENT NO. : 8,466,618 B2
APPLICATION NO. : 13/375370
DATED : June 18, 2013
INVENTOR(S) : Kando It is certified that error appears in the above-identified patent and that said Letters Patent is hereby corrected as shown below:

On the Title Page, in Item (73), under "Assignee", in Column 1, Line 2,
delete "Shizouka University, Shizouka-shi (JP)" and
insert -- Shizuoka University, Shizuoka-shi (JP) --, therefor.

Signed and Sealed this
Third Day of February, 2015

Michelle K. Lee

Michelle K. Lee
*Deputy Director of the United States Patent and Trademark Office*